United States Patent [19]

King et al.

[11] 4,340,842

[45] Jul. 20, 1982

[54] CHRISTMAS TREE DECORATION

[76] Inventors: Paul M. King, c/o George Spector, 3615 Woolworth Bldg., 233 Broadway; George Spector, 3615 Woolworth Bldg., 233 Broadway, both of New York, N.Y. 10007

[21] Appl. No.: 172,286

[22] Filed: Jun. 11, 1981

[51] Int. Cl.[3] ..... A63H 33/26

[52] U.S. Cl. ..... 315/186; 46/226; 315/84; 315/210; 315/200 A; 315/362; 362/152

[58] Field of Search ..... 362/152; 46/226, 228, 46/229; 315/84, 186, 193, 210, 322, 185 S, 200 A, 313, 362

[56] References Cited

U.S. PATENT DOCUMENTS

| | | | |
|---|---|---|---|
| 1,691,728 | 11/1928 | Matthai | 362/152 X |
| 1,754,123 | 4/1930 | Schrey | 362/152 X |
| 1,792,708 | 2/1931 | Ravert | 46/226 |
| 2,223,222 | 1/1940 | Morrison | 362/152 X |

*Primary Examiner*—Eugene R. LaRoche

[57] ABSTRACT

A decoration under a Christmas tree, including a miniature fence on each side of a little fence gate, each fence post having an electric lamp mounted upon its top, a spring-wound motor reciprocally swinging the gate open and closed, and each time the gate is closed, it activates an electric circuit that lights up the fence post lamps.

2 Claims, 3 Drawing Figures

CHRISTMAS TREE DECORATION

This invention relates generally to activated Christmas tree decorations.

A principal object of the present invention is to provide a colorful display under a Christmas tree wherein there is erected a tiny fence having a gate that automatically swings open, and each time the gate closes, then small electric lamps upon the fence posts light, up so to produce a pleasant scene.

Still another object is to provide a display decoration that can be used a part of a diorama that includes miniature houses, trees and figures of animals and people so as to form a scene of a village or other landscape.

Figure 1:
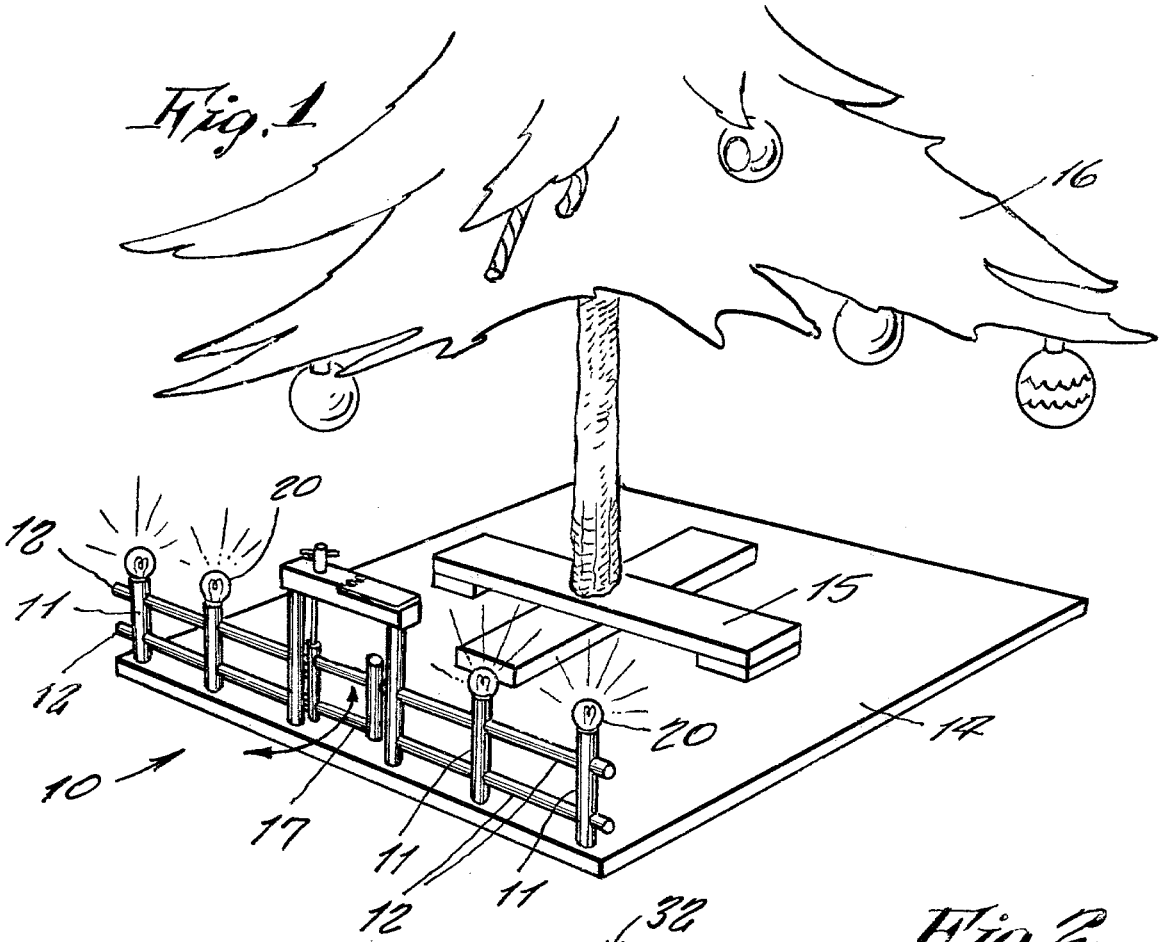
FIG. 1 is a perspective view of the invention, shown in front of a Christmas tree.
Figure 2:
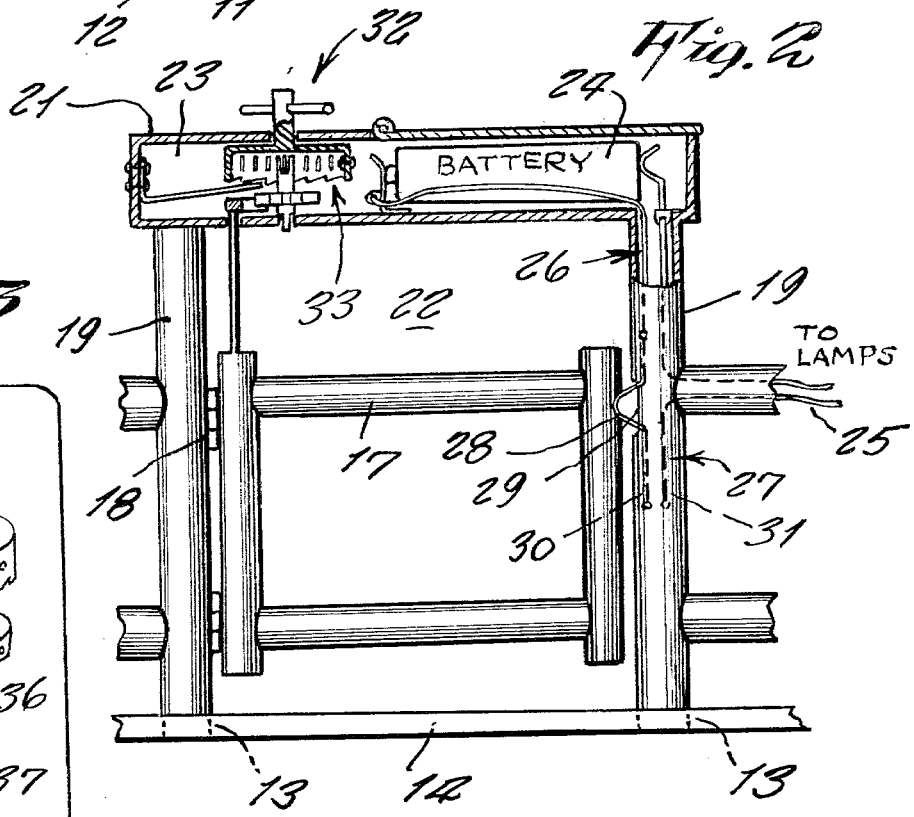
FIG. 2 is an enlarged cross sectional view of the gate frame thereof shown containing a replaceable battery that lights up the lamps each time that the gate is swinged open.
Figure 3:
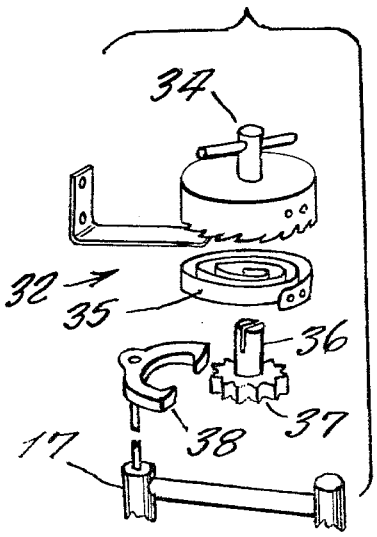
FIG. 3 shows a wind up mechanism that makes the gate to swing back and forth automatically so as to light up the lamps at each swing of the gate.

Referring now to the drawing in greater detail, the reference numeral 10 represents an electric lighted fence according to the present invention, wherein there are a plurality of vertical fence posts 11 supporting upper and lower fence rails 12 therebetween. In order that the fence can stand up, a lower end of the posts can be inserted into holes 13 provided therefor in a flat panel 14 which may be made either small or else large enough so as to fit under the stand 15 of a Christmas tree 16, as shown in FIG. 1. A center of the fence has a swinging gate 17 supported thereupon by means of hinges 18 mounted on gate post 19.

In the present invention, an electric lamp 20 is mounted on top of each fence post 11, the lamps being lighted automatically whenever the gate is swinged closed.

A beam 21 mounted across a top of the gate posts 19 defines a gateway 22 within which the gate is located.

The beam has a hollow central chamber 23 in which a replaceable dry cell battery 24 is contained and which is connected by wiring 25 extending inside the fence posts and rails to the lamps 20 so as to form an electrical circuit 26 which also includes a switch 27 in one of the gate posts 19, the switch having a contact arm or loop 28 of the wiring extending out of a hole 29 in a side of the fence post so to be inwardly pushed by the swinging gate in order that a movable contact 30 of the switch engages a stationary contact 31 thereof so as to close the circuit at such time and light the lamps.

A mechanism 32 also inside the chamber 23 serves to reciprocally swing the gate open and closed, so as to operate the switch 27. The mechanism includes a spring-wound motor 33 that is wound up by a knob 34 protruding upward out of the beam. The motor includes a spiraled leaf spring 35 for powering a shaft 36 having a ratchet wheel 37 engaged by an escapement dog 38 affixed on the gate.

In operative use, as the gate is swinged back and forth by the mechanism, it closes the switch momentarily so to light up the lamps.

While various changes may be made in the detail construction, it is understood that such changes will be within the spirit and scope of the present invention as is defined by the appended claims.

What is claimed:

1. An electric lighted fence, comprising in combination, a miniature decorative display including a fence and a gate hinged on said fence, said fence being comprised of a plurality of fence posts and rails therebetween, a lamp on each said fence post, an electrical circuit to light up said lamps, and a mechanism to reciprocally swing said gate, said gate opening and closing a switch of said circuit.

2. The combination as set forth in claim 1, wherein said switch comprises a looped contact arm extending in a path of said swinging gate so to move a contact thereof into engagement swith a stationary contact of said switch.

* * * * *